US010344439B2

(12) United States Patent
Steffen et al.

(10) Patent No.: US 10,344,439 B2
(45) Date of Patent: Jul. 9, 2019

(54) SOIL COMPACTING DEVICE

(71) Applicant: Wacker Neuson Produktion GmbH & Co. KG, Reichershoven (DE)

(72) Inventors: Michael Steffen, Munich (DE); Walter Unverdorben, Markt Indersdorf (DE)

(73) Assignee: Wacker Neuson Produktion GmbH & Co. KG, Reichershoven (DE)

( * ) Notice: Subject to any disclaimer, the term of this patent is extended or adjusted under 35 U.S.C. 154(b) by 0 days.

(21) Appl. No.: 16/129,083

(22) Filed: Sep. 12, 2018

(65) Prior Publication Data

US 2019/0078282 A1 Mar. 14, 2019

(30) Foreign Application Priority Data

Sep. 13, 2017 (DE) ..... 10 2017 121 177

(51) Int. Cl.

| | |
|---|---|
| ***E02D 3/00*** | (2006.01) |
| ***E02D 3/074*** | (2006.01) |
| ***B06B 1/16*** | (2006.01) |
| ***E01C 19/38*** | (2006.01) |

(52) U.S. Cl.

CPC ..... *E02D 3/074* (2013.01); *B06B 1/161* (2013.01); *E01C 19/38* (2013.01)

(58) Field of Classification Search

CPC ..... E02D 3/074; B06B 1/161

USPC ..... 404/113, 133.05–133.2; 74/87

See application file for complete search history.

(56) References Cited

U.S. PATENT DOCUMENTS

| | | | | |
|---|---|---|---|---|
| 3,339,422 | A * | 9/1967 | Petrin | B06B 1/163 74/87 |
| 3,889,263 | A * | 6/1975 | Johannessen | G01S 1/24 331/165 |
| 6,213,630 | B1 | 4/2001 | Kossmann | |
| 6,213,681 | B1 * | 4/2001 | Sick | E01C 19/38 366/116 |
| 6,717,379 | B1 | 4/2004 | Andersson | |
| 9,038,491 | B2 * | 5/2015 | Burton | B06B 1/161 74/87 |
| 2013/0251452 | A1 * | 9/2013 | Steffen | E01C 19/35 404/133.05 |

FOREIGN PATENT DOCUMENTS

| | | | |
|---|---|---|---|
| DE | 298 04 993 | U1 | 6/1998 |
| DE | 199 53 553 | A1 | 6/2000 |
| EP | 1 267 001 | A1 | 4/2002 |
| EP | 1 267 001 | A1 | 12/2002 |
| WO | 00/55430 | A1 | 9/2000 |

* cited by examiner

*Primary Examiner* — Raymond W Addie

(74) *Attorney, Agent, or Firm* — Boyle Fredrickson, S.C.

(57) ABSTRACT

A vibratory plate for soil compaction machine has an upper mass and a lower mass that is elastically coupled to the upper mass and that has a soil contact plate. The soil contact plate has a vibration exciter device. At least one energy storage element is situated on the upper mass.

9 Claims, 4 Drawing Sheets

SOIL COMPACTING DEVICE

BACKGROUND OF THE INVENTION

1. Field of the Invention

The present invention relates to a vibratory plate for soil compaction, having an upper mass and having a lower mass that is elastically coupled to the upper mass and that has a vibration exciter device.

2. Description of the Related Art

Such vibratory plates have long been known and are used to compact loose soil in construction work. For example, when filling excavation pits, or when filling sand and crushed rock, the material has to be compacted in order to produce the required load-bearing capacity. Only after this has been done can a finishing layer of tar or plaster be applied.

Vibratory plates have proven useful because they are available in different sizes and weight classes, so that a suitable machine is available for any application. Alternatively, rollers can also be used, but, due to their size and the associated increased transport expense, these are used only on larger surfaces.

Vibratory plates are standardly driven by internal combustion engines. The internal combustion engine is situated on the upper mass. The drive force of the engine is transmitted from the upper mass to a vibration exciter, situated on the lower mass, by a belt drive or via a hydraulic connection. Due to the elastic coupling between the upper and lower mass, the transmission of the drive force by a belt or by hydraulic lines frequently causes problems and requires at least regular maintenance and checking. In addition, the internal combustion engine requires maintenance, and produces exhaust gases that are damaging to health to which the operator is exposed in poorly ventilated construction areas, such as a trench.

In EP 1 267 001, which is of the same generic type, it has been proposed to equip a vibratory plate with an electrical drive, the required electrical energy being provided by a rechargeable accumulator carried along with the device. Both the accumulator and the electric drive motor are situated on the upper mass.

The object of the present invention is to indicate a vibratory plate that reduces the disadvantages of the known vibratory plates and has a simple and low-maintenance construction.

SUMMARY OF THE INVENTION

According to the present invention, the object is achieved by a vibratory plate having the features of Claim 1. Advantageous embodiments of the present invention are indicated in the dependent claims.

A vibratory plate for soil compaction includes an upper mass on which at least one energy storage element is situated. The upper mass is coupled elastically to a lower mass that has at least one soil contact plate and a vibration exciter device that acts on the lower mass. The vibration exciter device has at least one electric motor that drives a rotatably mounted imbalance mass in rotational fashion, and that can be driven by the electrical energy of the at least one energy storage element. Due to its use of electrical energy as drive force, such a vibratory plate does not produce noxious exhaust gases. In addition, the motor that provides the drive force for the imbalance mass is situated on the lower mass, so that no mechanical or hydraulic energy has to be transmitted from the upper mass to the lower mass.

In a specific embodiment, a shaft of the electric motor can extend transverse to a longitudinal axis of the vibratory plate. This configuration is advantageous for driving the imbalance masses. In this way, a redirection of the rotation can be omitted. The longitudinal axis of the vibratory plate is defined on the basis of the direction of advance of the vibratory plate. During operation, the vibratory plate moves in a forward direction with the front end of the vibratory plate in front, while the operator guides the vibratory plate by a grip bar at the rear end of the vibratory plate. The longitudinal axis extends centrically from the front end of the vibratory plate to the rear end of the vibratory plate.

In addition, the vibration exciter device can have an electric motor having two imbalance masses, the electric motor being situated axially between the two imbalance masses. The imbalance masses are connected to the shaft of the electric motor so as to be capable of rotation. The situation of the motor centrally between the imbalance masses achieves a uniform weight distribution to the lower mass. In addition, the mounting of the two imbalance masses and of the motor shaft is made easier.

It has turned out to be particularly suitable if the at least one electric motor is realized as a brushless electric motor, in particular as an electric motor of one of the types: BLDC motor, SR motor, or asynchronous motor. So-called BLDC motors are also known as brushless DC motors or brushless direct-current motors. SR motors are also known as reluctance motors. All of these motors are distinguished by their brushless design, and thus their essentially maintenance-free and wear-free operation. The motors operate reliably over a long period of time and can also be used in typically rough construction site conditions.

Another variant results if the vibration exciter device has at least two electric motors each having an associated imbalance mass, the electric motors, together with the associated imbalance masses, being situated spatially separate from one another on the lower mass. The use of two electric motors with the associated imbalance masses improves the movement behavior of the vibratory plate. The vibratory plate is more pleasant to operate for the operator than is the case when only one electric motor having an associated imbalance mass is used.

In a specific embodiment, the at least two electric motors can be situated in staggered fashion along the longitudinal axis of the vibratory plate. This configuration distributes the drive force of the imbalance masses to the vibratory plate in more uniform fashion and yields a better compaction result.

It has turned out to be particularly advantageous if the vibratory plate has an electronic control unit that controls and/or regulates the direction of rotation and speed of rotation of the at least one electric motor. The monitoring of the energy storage device, such as a so-called battery management system, can also be integrated in the electronic control unit.

In addition, the electronic control unit can be designed to control and/or to regulate the direction of rotation and/or rotational speed of at least two electric motors, and to adjust them independently of one another. When two electric motors are used, an independent controlling of the two motors can result in advantageous movement properties of the vibratory plate. For example, in this way a backward travel of the vibratory plate can be set if the electric motors are set such that the resultant force vectors of the respective imbalance masses cause backward travel. In addition, for example stationary vibration can be set, or a variation of the advance speed can be set.

It has proved particularly advantageous for the electronic control unit to be situated on the lower mass. In this configuration, the electrical connections between the control unit and the electric motor(s) are very short. This improves the response time of the electric motor(s). Because during operation the motors generally rotate very quickly, and in particular brushless electric motors require very fast control or regulation commands, the spatially close configuration of the individual components confers advantages.

In another advantageous design, the energy storage element is situated on the upper mass so as to be vibrationally decoupled therefrom. The lower mass is indeed connected in spring-loaded fashion to the upper mass. Nonetheless, the upper mass, and thus also the energy storage element, are exposed to vibrations. The useful life of the energy storage element can be prolonged if the vibrations are kept away from it to the greatest possible extent. A vibratory decoupling can be achieved for example by disposing rubber bumpers between the energy storage unit and the upper mass.

These, and additional, advantages and features of the present invention are explained in more detail below on the basis of examples, with the aid of the accompanying Figures.

DETAILED DESCRIPTION OF THE PREFERRED EMBODIMENT

Figure 1:
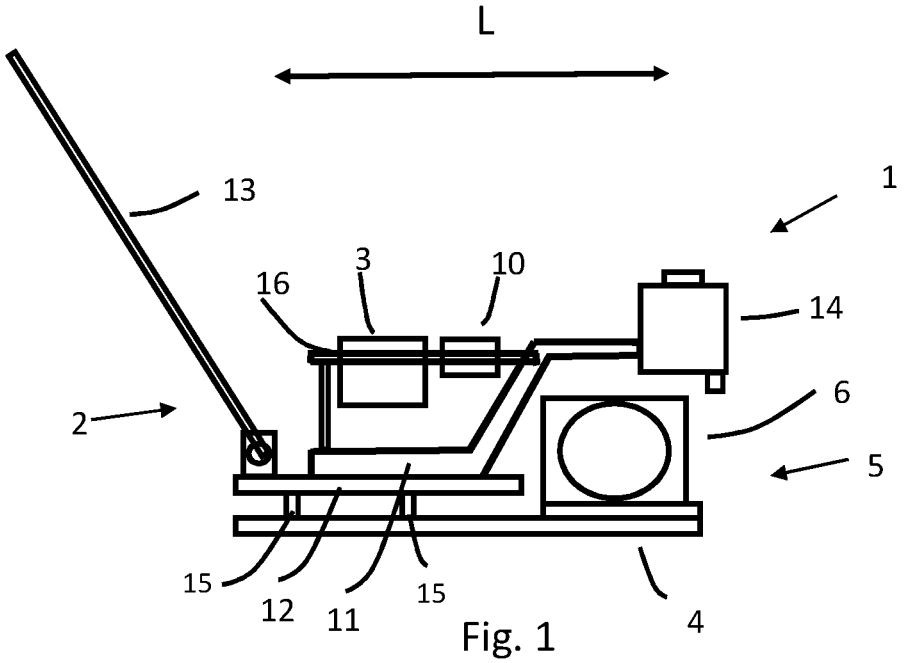
FIG. 1 shows a schematic side view of a variant of a vibratory plate according to the present invention.

FIG. 1 shows, in a schematic side view, a variant of the vibratory plate 1 according to the present invention, having an upper mass 2 and a lower mass 5. The upper mass 2 includes a bearing frame 11 that is connected to a bearer plate 12. In addition, in the depicted exemplary embodiment the upper mass has at least one energy storage element 3 and an electronic control unit 10, which are situated on the bearing frame 11. In addition, the upper mass 2 includes an irrigation device 14 and a guide bar or drawbar 13 by which an operator can steer the vibratory plate.

On the drawbar 13 there is situated at least one operating element with which an operator can control and/or regulate the function of the vibratory plate, i.e. can in particular switch the vibratory plate on and off.

The drawbar 13 is situated on the upper mass 2 so as to be vibrationally decoupled therefrom, so that damaging vibrations are transmitted to the drawbar, and thus to an operator, to only a reduced extent.

The irrigation device 14 includes a container that holds water, which can be emitted onto the soil to be compacted from an outlet that can be closed and opened in a controlled fashion during operation of the vibratory plate. This is advantageous in particular when compacting tar in order to prevent the vibratory plate from adhering to the tar.

The upper mass is connected to the lower mass 5 by damping elements 15. The lower mass 5 includes a soil contact plate 4 by which the vibratory plate 1 moves over the soil to be compacted, and acts on this soil. In addition, the lower mass 5 includes a vibration exciter device 6 that produces mechanical vibrations and transmits them to the soil contact plate 4, to which it is connected.

In the exemplary embodiment shown in FIG. 1, the energy storage element 3 is situated on the upper mass 2 in vibrationally dampened fashion. For this purpose, the energy storage element 3 is situated on a mount 16 that is connected to the upper mass 2 in vibrationally dampened fashion. This can be achieved through a fastening using rubber bumpers, or by a rotational joint. Alternatively, the energy storage element 3 can also stand in contact with the upper mass via vibration-dampening elements, such as rubber bumpers. In a variant, the electronic control unit 10 can also be situated on the upper mass 2 in vibrationally dampened fashion, for example by also situating this control unit on the mount 16.

The electronic control unit 10 is used to control and/or to regulate the vibration exciter device 6. The electronic control unit 10 is designed to influence and to adjust the electric motor 7 of the vibration exciter device 6, i.e. in particular to set and to vary its rotational speed and direction of rotation. If, in a specific embodiment according to the present invention, a vibration exciter device 6 is provided having a plurality of electric motors, then the electronic control unit 10 is designed to adjust and to influence the respective electric motors 7 independently of one another. In a variant, it is also possible to control one or more electric motors 7 as a function of the state of one or more other electric motors 7. Thus, for example the rotational speed and/or direction of rotation of a first electric motor 7 can be used as a reference for another electric motor 7, on the basis of which the other electric motor 7 is then adjusted.

An electric motor 7 together with the associated imbalance mass or masses 8 forms a so-called exciter or imbalance exciter.

Figure 2:
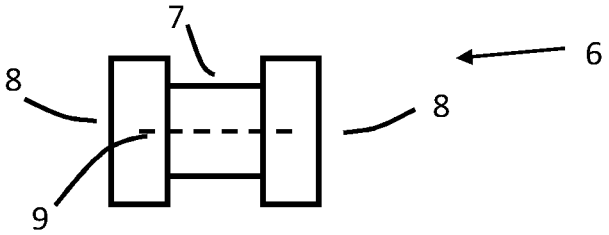
FIG. 2 shows a schematic top view of a vibration exciter device.

FIG. 2 shows an example of a vibration exciter device 6. The vibration exciter device 6 includes an electric motor 7 by which at least one imbalance mass 8 can be set into rotation. For this purpose, the imbalance mass 8 is preferably connected to the motor shaft 9 of the electric motor 7. Preferably, the electric motor 7 is situated between two imbalance masses 8, so that this motor is positioned centrally and axially between the imbalance masses 8. The motor shaft 9 of the electric motor 7 can be led out from the motor housing at both sides of the electric motor. The imbalance masses 8 can be fastened to the two ends of the motor shaft. Alternatively, the motor shaft 9 can also be realized such that the imbalance masses 8 are an integral part of the motor shaft 9.

In addition, according to the present invention it is possible for the motor shaft 9 of the electric motor 7 to be led out only from one side of the motor housing, and for only one imbalance mass 8 to be fastened thereto. This variant provides the possibility of orienting two electric motors axially to one another, the motor shafts 9 of the electric motors 7 being led out from the motor housings at opposite sides, each oriented away from the motors, and a respective imbalance mass 8 being situated on each motor shaft. In this way, the electric motors can be controlled independently of one another, and can apply different centrifugal forces to the lower mass via different directions of rotation and/or rotational speeds, thus enabling various driving maneuvers.

In terms of drive, the vibration exciter device 6 is mechanically autarkic relative to the upper mass 2, i.e. only electrical energy is supplied to the vibration exciter device. From the electrical energy, the electric motor 7 produces the mechanical force for driving the imbalance mass(es) 8. That is, only electrical energy is supplied to the vibration exciter device, and it is not connected to the upper mass by a belt drive or by a hydraulic system. For the supply of the electrical energy, the electric motor 7 is connected to the upper mass by an electrical cable that is not shown in the Figures.

Figure 3:
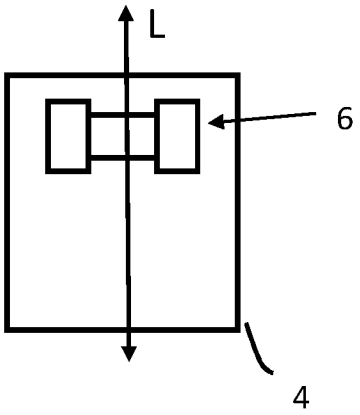
FIG. 3 shows a schematic top view of a lower mass having a vibration exciter device.

FIG. 3 shows a schematic top view of a soil contact plate 4 having a vibration exciter device 6. The vibration exciter device 6 is situated on the soil contact plate 4 and is connected fixedly thereto. The vibration exciter device 6 is situated centrally in the longitudinal direction, i.e. centrically relative to the soil contact plate 4, and the motor shaft runs transverse to the longitudinal direction of the vibratory plate. Here, the longitudinal direction is determined by the direction of movement of the vibratory plate during operation.

In addition, the vibration exciter device 6 is situated in a front half of the soil contact plate 4. This positioning provides the vibratory plate 1 with the best movement properties. Particularly preferably, the vibration exciter device 6 is situated in a front third of the soil contact plate 4. During use of a vibration exciter device 6, the vibratory plate 1 can move in only one direction. The rotation of the imbalance masses 8 brings about an acceleration of the vibratory plate 1 forward and upward. The soil contact plate 4 therefore briefly loses contact with the soil in the region of the vibration exciter device 6 and accelerates the vibratory plate 1 forward. The vibratory plate 1 is thus so to speak dragged over the soil by means of the vibration exciter device 6, and for this reason this type of vibratory plate is also referred to as a "dragging vibrator." However, plate compactors of this sort enable only forward travel of the vibratory plate 1. The "forward direction" or "front end" of the vibratory plate is meant to refer to the direction opposite the end of the vibratory plate 1 having the guide bar 1). In other words, the vibratory plate 1 moves in the forward direction away from the operator. This definition holds for all exemplary embodiments in the present application.

Figure 4:
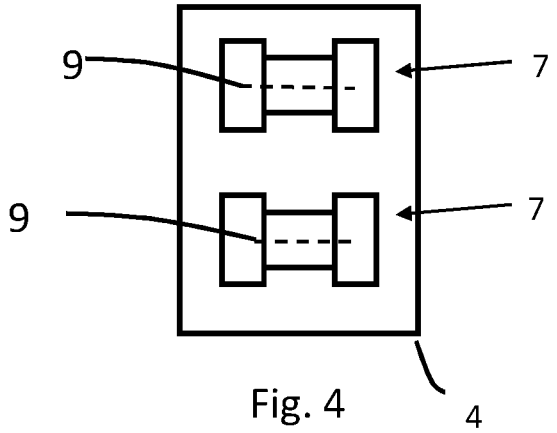
FIG. 4 shows a schematic top view of a lower mass having two vibration exciters.

FIG. 4 shows a variant of the vibratory plate 1 having two electric motors 7 or imbalance exciters. Here, a first electric motor 7 is situated in a first half of the soil contact plate 4 and a second electric motor 7 is situated in a second half of the soil contact plate 4. The use of two electric motors 7 results in an improved compaction performance and a more uniform movement behavior of the vibratory plate 1. Here, the motor shafts 9 of the two electric motors 7 are oriented parallel to one another and run transverse to the longitudinal axis of the vibratory plate.

A vibratory plate 1 of this design can move not only forward but also backwards and can execute stationary vibration. The basic technical principles underlying this are known from the existing art and are therefore not stated in more detail here.

Through the respective setting and orientation of the respective imbalance masses, and thus the resulting centrifugal forces of the two electric motors 7, either forward motion, backward motion, or stationary vibration can be set. In addition, the speed of movement can be continuously adjusted between a maximum forward speed and a maximum backward speed. This is achieved using the electronic control unit, which is capable of controlling and setting the electric motors 7 independently of one another.

During backward travel, the vibratory plate 1 moves toward the operator, i.e. in the direction of the end of the vibratory plate at which the guide bar 13 is situated.

Figure 5:
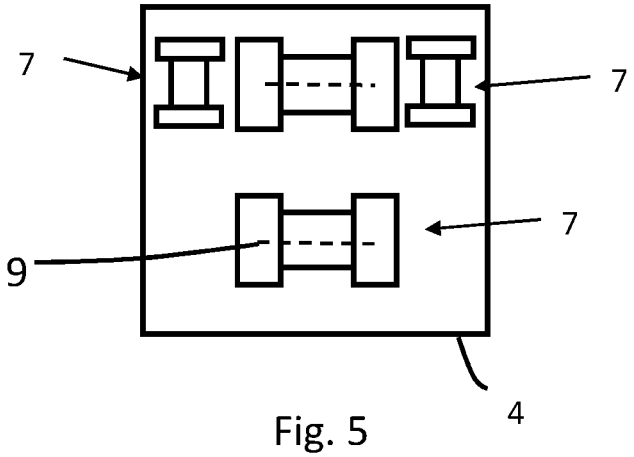
FIGS. 5 through 9 show schematic top views of a lower mass having a plurality of vibration exciters.

Another variant is shown in FIG. 5; here, in addition to the two electric motors 7 shown in FIG. 4, at least one additional electric motor 7 is situated on the soil contact plate 4. Here, two electric motors 7 are situated with motor shafts 9 transverse to the longitudinal axis of the vibratory plate 1, and at least one further electric motor 7 is situated with its motor shaft oriented along, i.e. parallel to, the longitudinal axis. In the depicted exemplary embodiment, two electric motors 7 are oriented with their motor shafts parallel to the longitudinal axis.

By means of this configuration, it is possible to realize the vibratory plate 1 so that its direction can be controlled. When, in the following, directional control is mentioned, a rotation of the vibratory plate 1 about its vertical axis is meant. In this case, the vibratory plate 1 can be controlled not only forward and backward, but for example also to the left and to the right. For this purpose, the directions of rotation and rotational speeds of the electric motors 7 oriented longitudinally to the longitudinal axis are set according to the travel desired by the operator, so that corresponding centrifugal forces are produced that move the vibratory plate 1 in the desired direction. Here as well, the electronic control unit is realized so as to control each of the electric motors 7 individually and independently of one another.

Figure 6:
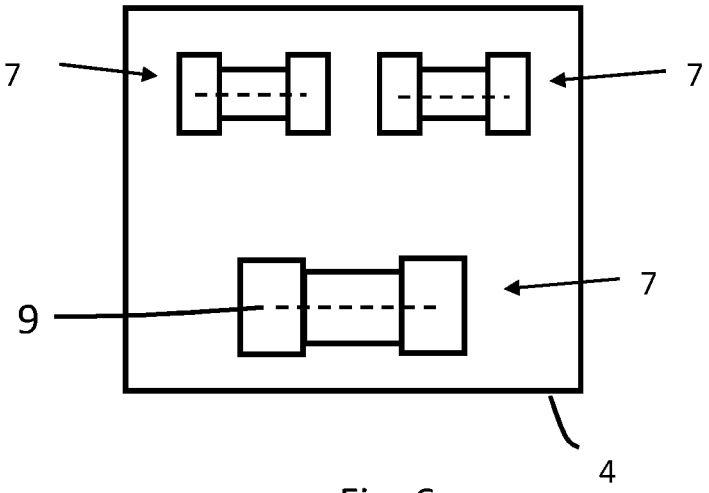

Another possibility for directional controlling of a vibratory plate 1 results from the design of the variant shown in FIG. 6. Here, three electric motors 7 are situated on the soil contact plate 4. Two of these electric motors 7 are oriented axially to one another. If a centrifugal force, i.e. rotational speed, is set higher in one of the axially oriented electric motors 7 than in the other axially oriented electric motor 7, the vibratory plate moves in its direction. If both axially oriented electric motors 7 are running in the same direction of rotation and with the same rotational speed, forward travel results.

Figure 7:
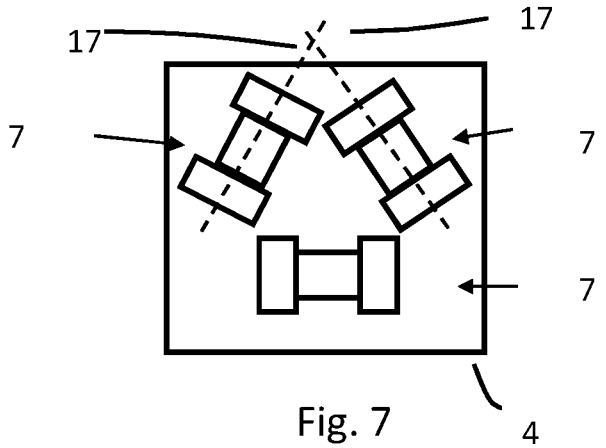

Another possibility for directional control of a vibratory plate 1 results from the design of the variant shown in FIG. 7. Here, three electric motors 7 are situated on the soil contact plate 4. Two of these electric motors 7 are disposed at an angle to one another. That is, the axes 17 of the electric motors 7, formed by the motor shafts 9, intersect. Curved travel, i.e. rotation about the vertical axis of the vibratory plate, can be set through the different setting of the rotational speeds, or also of the direction of rotation.

Figure 8:
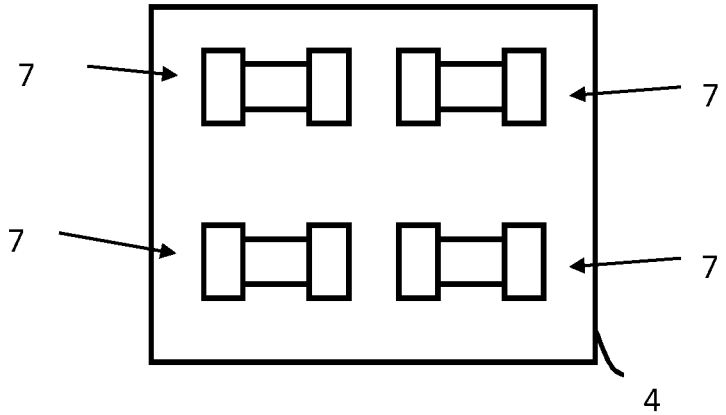

In addition, directional control is also possible with the design shown in FIG. 8. Here, in the depicted exemplary embodiment four electric motors 7 are situated on the soil contact plate 4. Here two electric motors 7 are oriented axially to one another. In front of or behind these, in staggered fashion, another two electric motors 7 are oriented axially to one another. When one or both electric motors 7 at one side of the longitudinal axis of the vibratory plate are controlled, there results a steering movement, or rotation about the vertical axis. The rotational movement can be amplified by causing the two electric motors 7 at the other side of the longitudinal axis to rotate in the opposite direction.

Figure 9:
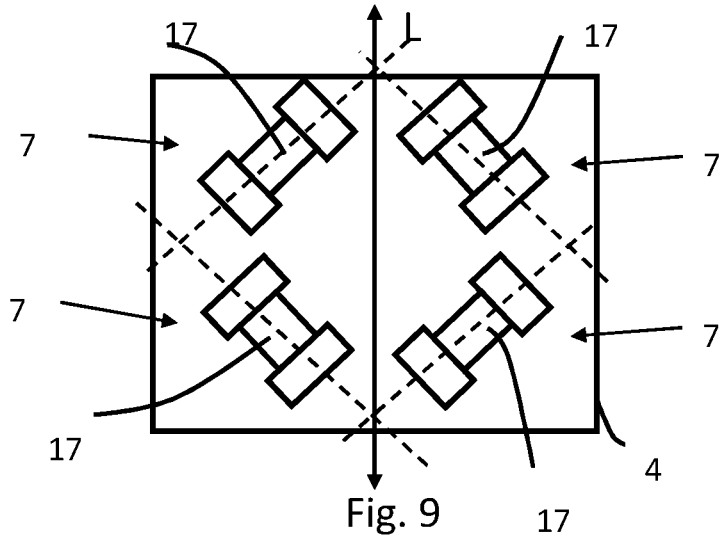

Alternatively to the design shown in FIG. 8, a configuration of the electric motors 7 as shown in FIG. 9 is also possible. Here, the electric motors 7 are disposed at an angle to one another in such a way that the motor axis 17 of one electric motor 7 intersects the motor axes 17 of two other electric motors 7. Thus, the electric motors are all configured at an angle to the longitudinal axis of the vibratory plate 1, i.e. are configured in such a way that the motor axes 17 of all the electric motors intersect the longitudinal axis of the vibratory plate 1. Preferably, the point of intersection of the motor axes 17 of two electric motors 7 lies on the longitudinal axis of the vibratory plate 1.

The configuration can be chosen such that at least two of the electric motors 7 are situated in mirror-image fashion relative to the longitudinal axis. Preferably, four electric motors 7 are configured in such a mirrored fashion relative to the longitudinal axis.

Such a configuration offers advantages with regard to the straight-ahead travel of the vibratory plate, and also improves steerability, i.e. the rotation about the vertical axis.

Figure 10:
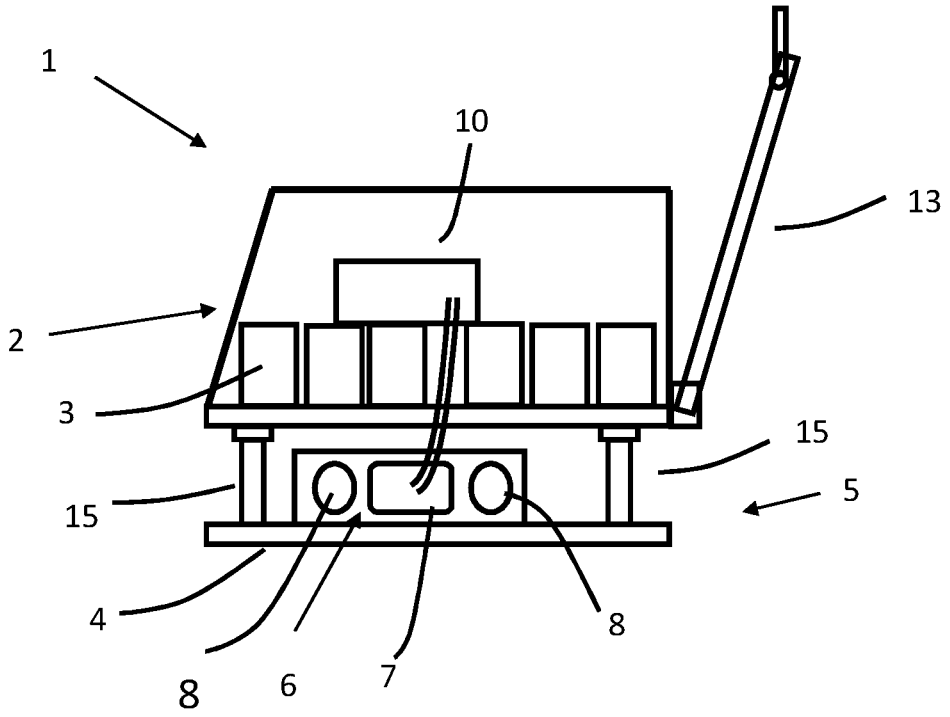
FIG. 10 shows a schematic side view of a variant of a vibratory plate according to the present invention.

Another variant design of a vibratory plate according to the present invention is shown in FIG. 10. Here, the energy storage element 3 is made up of a multiplicity of individual accumulators that are situated on the upper mass 2 and are wired to one another. An electronic control unit 10 is provided for the controlling of the motor or motors. In the depicted exemplary embodiment, the electronic control unit 10 is situated on the upper mass 2. However, in general, i.e. independent of the depicted exemplary embodiment, it is also possible to situate the electronic control unit 10 on the lower mass 5.

In the depicted exemplary embodiment, the vibration exciter device 6 is made having only one electric motor 7, which drives two imbalance masses 8.

In general, i.e. independent of the presented specific embodiments, it is possible to form the energy storage element from individual accumulator cells. The accumulator cells can be individually exchangeable.

In addition, it is possible to provide an electronic charging module on the vibratory plate 1, for charging the energy storage element 3. This enables charging of the energy storage device directly on the vibratory plate 1. In this way, it is not necessary to remove the energy storage unit and to transport it to the charging module. The charging module can be constructively integrated with the electronic control unit.

The stated features of the present invention are not limited to the combinations of features shown in the Figures, but rather can be combined with one another as desired.

What is claimed is:

1. A vibratory plate for soil compaction, comprising:

an upper mass on which at least one energy storage element and a drawbar are each situated;

a lower mass that is elastically coupled to the upper mass and that has a soil contact plate; and a vibration exciter device that acts on the soil contact plate, wherein the vibration exciter device has at least one electric motor that rotationally drives at least one rotatably mounted imbalance mass, and that is capable of being driven by the electrical energy of the at least one energy storage element, wherein the electric motor has two imbalance masses, the electric motor being situated axially between the two imbalance masses, and wherein the electric motor is arranged on the lower mass.

2. The vibratory plate as recited in claim 1, wherein a shaft of the electric motor extends transverse to a longitudinal axis of the vibratory plate.

3. The vibratory plate as recited in claim 1, wherein the energy storage element is situated on the upper mass so as to be vibrationally decoupled therefrom.

4. The vibratory plate as recited in claim 1, wherein at least one electric motor is a brushless electric motor consisting of one of a BLDC motor, an SR motor and an asynchronous motor.

5. The vibratory plate as recited in claim 1, wherein vibration exciter device has at least two electric motors having respectively associated imbalance masses, the electric motors, together with, the associated imbalance masses, being situated spatially separate from one another on the lower mass.

6. The vibratory plate as recited in claim 5, wherein at least two electric motors are configured, in staggered fashion along a longitudinal axis of the vibratory plate.

7. The vibratory plate as recited in claim 1, wherein the vibratory plate has an electronic control unit that controls and/or regulates the direction of rotation and/or rotational speed of the at least one electric motor.

8. The vibratory plate as recited in claim 7, wherein the electronic control unit is designed to control and/or to regulate the direction of rotation and rotational speed of at least two electric motors and adjusts said speeds independently of one another.

9. The vibratory plate as recited in claim 7, wherein the electronic control unit is situated on the lower mass.

* * * * *